US008576130B2

(12) United States Patent
Dai

(10) Patent No.: US 8,576,130 B2
(45) Date of Patent: Nov. 5, 2013

(54) WIDEBAND ANTENNA

(75) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 397 days.

(21) Appl. No.: 12/910,357

(22) Filed: Oct. 22, 2010

(65) Prior Publication Data

US 2012/0098715 A1 Apr. 26, 2012

(51) Int. Cl.
*H01Q 1/32* (2006.01)

(52) U.S. Cl.
USPC ..... 343/713; 343/712

(58) Field of Classification Search
USPC ..... 343/711, 712, 713, 906
See application file for complete search history.

(56) References Cited

U.S. PATENT DOCUMENTS

| | | | | |
|---|---|---|---|---|
| 4,768,037 | A | 8/1988 | Inaba et al. | |
| 4,849,766 | A | 7/1989 | Inaba et al. | |
| 4,864,316 | A | 9/1989 | Kaoroi | |
| 4,987,424 | A | 1/1991 | Tamura et al. | |
| 5,005,020 | A | 4/1991 | Ogawa et al. | |
| 5,083,135 | A | 1/1992 | Nagy et al. | |
| 5,132,161 | A | 7/1992 | Shibata et al. | |
| 5,355,144 | A | 10/1994 | Walton et al. | |
| 5,528,314 | A | 6/1996 | Nagy et al. | |
| 5,898,407 | A * | 4/1999 | Paulus et al. | 343/713 |
| 6,020,855 | A | 2/2000 | Nagy et al. | |
| 6,097,345 | A * | 8/2000 | Walton | 343/769 |
| 6,384,790 | B2 | 5/2002 | Dishart et al. | |
| 6,448,935 | B2 | 9/2002 | Fuchs et al. | |
| 6,730,389 | B2 | 5/2004 | Voeltzel | |
| 6,937,198 | B2 | 8/2005 | Iijima et al. | |
| 7,190,326 | B2 | 3/2007 | Voeltzel | |
| 7,289,073 | B2 | 10/2007 | Song et al. | |
| 7,388,549 | B2 | 6/2008 | Chiang | |
| 7,427,961 | B2 | 9/2008 | Song et al. | |
| 2005/0195115 | A1 | 9/2005 | Yegin et al. | |
| 2009/0256757 | A1 | 10/2009 | Chiang et al. | |

FOREIGN PATENT DOCUMENTS

| | | | |
|---|---|---|---|
| EP | 0561272 | | 9/1993 |
| JP | 0375415 | | 6/1990 |
| JP | 11163625 | * | 6/1999 |

OTHER PUBLICATIONS

Oshima et al., "Use of a Transparent Conductive Thin-film on a Glass Substrate in Active Integrated Antenna Arrays with Double Strong Coupling", IEEE MTT-S Digest, 1569-1572 (2002).

Katsounaros A. et al., "Optically Transparent Ultra-Wideband Antenna", Electronics Letters, vol. 45, No. 14, (2002).

* cited by examiner

*Primary Examiner* — Hoanganh Le
(74) *Attorney, Agent, or Firm* — Cohen & Grigsby, P.C.

(57) ABSTRACT

A vehicle window assembly. The window assembly includes a frame having an inner metal edge and a window pane fixed to the frame. The window pane includes an inner glass ply, an outer glass ply, an interlayer between the inner glass ply and the outer glass ply, and an electro-conductive coating located on a surface of the outer glass ply, wherein the electro-conductive coating has an outer peripheral edge spaced from the inner metal edge of the frame to define an antenna slot. The window assembly also includes an antenna feed structure electrically connected to the outer peripheral edge of the electro-conductive coating and a capacitive coupling strip located on the inner glass ply and overlapping the outer peripheral edge of the electro-conductive coating proximate the antenna feed structure, wherein the coupling strip couples a wide bandwidth radio frequency signal into and out of the antenna slot.

46 Claims, 3 Drawing Sheets

WIDEBAND ANTENNA

BACKGROUND

As an alternative to standard whip antennas and roof mount mast antennas, automotive vehicle window antennas have been used for many years including embedded wire or silver print antennas in rear windows and windshields. More recently, metal coated infrared ray reflective thin films have been used as antennas for vehicles. Other antenna arrangements incorporate a slot antenna between the metal frame of a vehicle window and a conductive transparent film panel that is bonded to the window and has an outer peripheral edge spaced from the inner edge of the window frame to define the slot antenna. Various such arrangements utilize at least one edge of the conductive coating overlapping the window frame of the vehicle body to form a short to the ground at high frequencies by coupling to improve transmission and reception of radio frequency waves.

With rapid growth in the performance requirements of vehicle electronics, more and more antennas have been integrated into vehicles. At FM and TV frequencies in particular, antenna systems require a number of antennas for diversity operation to overcome multipath and fading effects. In existing systems, separate antennas and antenna feeds are used to meet such requirements. For example, up to 11 antennas with separate feed points and multiple modules have been used to cover AM, FM/TV diversity, weather band, Remote Keyless Entry, and DAB Band III, with most of the antennas being integrated into back window glass. Multiple coaxial cables running from antennas to the receiver can be avoided by combining the separate antenna signals using an electrical network. Such a network, however, involves the added complexity and expense of a separate module. Thus, in order to limit the complexity and expense of an on-glass antenna system, it may be desirable to keep the number of antenna feeds to a minimum.

Thus, there is a need for a single feed antenna, in particular an IR reflective windshield antenna, that provides wide bandwidth characteristics for different applications. There is also a need for an antenna system that reduces the number of antennas on a vehicle and simplifies the antenna and its associated electronics by using antenna matching and frequency tuning methods. It is desirable for such an antenna to meet system performance requirements while retaining the solar benefits of the heat reflective coating of the window while maintaining good aesthetics.

SUMMARY

Embodiments of the present invention are directed to a vehicle window assembly. The window assembly includes a frame having an inner metal edge and a window pane fixed to the frame. The window pane includes an inner glass ply, an outer glass ply, an interlayer between the inner glass ply and the outer glass ply, and an electro-conductive coating located on a surface of the outer glass ply, wherein the electro-conductive coating has an outer peripheral edge spaced from the inner metal edge of the frame to define an antenna slot. The window assembly also includes an antenna feed structure electrically connected to the outer peripheral edge of the electro-conductive coating and a capacitive coupling strip located on the inner glass ply and overlapping the outer peripheral edge of the electro-conductive coating proximate the antenna feed structure, wherein the coupling strip couples a wide bandwidth radio frequency signal into and out of the antenna slot.

Embodiments of the present invention are directed to a vehicle window assembly. The window assembly includes a glass ply and an electro-conductive coating located on a surface of the outer glass ply, wherein the electro-conductive coating has an outer peripheral edge spaced from the inner metal edge of the frame to define an antenna slot. The window assembly also includes a capacitive coupling strip located on the glass ply and overlapping the outer peripheral edge of the electro-conductive coating proximate an antenna feed structure, wherein the coupling strip couples a wide bandwidth radio frequency signal into and out of the antenna slot.

Those and other details, objects, and advantages of the present invention will become better understood or apparent from the following description and drawings showing embodiments thereof.

BRIEF DESCRIPTION OF THE DRAWINGS

Various embodiments of the present invention are described herein by way of example in conjunction with the following figures, wherein.

DETAILED DESCRIPTION

Embodiments of the present invention are directed to a multiband slot antenna for a vehicle. The slot antenna forms between the metal frame of a window and a conductive transparent coating panel that is bonded to the window and has an outer peripheral edge spaced from the inner edge of the window frame to define the slot antenna. In various embodiments, the slot dimensions and feeding network are such as to support wide bands, including, for example, FM, TV VHF/UHF, weather band, remote keyless entry system (RKE), and DAB band III. The antenna may use only a single antenna feed and may be located behind a dark, or black, paint band and, therefore, avoid obscuration of visible areas of a window.

Embodiments of the present invention provide a multiband antenna for, for example, a mobile vehicle. A strip-like antenna feeding element is disposed at the perimeter of the coating panel and is capacitively connected to the coating panel at a high frequency. A coaxial transmission line is connected to the antenna with a shielding terminal connected to the vehicle frame and the main terminal to the antenna element. The coating is extended and overlaps the antenna feeding element area, but is located away from the vehicle frame such that the slot antenna is not shorted to ground. The size of the overlapped area is determined by the capacitance needed for feeding the antenna and may be adjusted to match the antenna at, for example, the VHF frequency band.

In the UHF band, the slot antenna impedance is predominately reactive and a matching circuit may be desirable in order to excite the higher order modes. In embodiments of the present invention, a printed trace inductor is integrated into the antenna coupling element on the surface of an inner glass ply of the window. The reactance of the inductor is tuned to match the antenna for the TV UHF band. The reactance of the inductor in various embodiments is very small at the VHF band and, therefore, does not significantly affect the antenna performance at the VHF band.

In various embodiments, the slot antenna is fed by capacitive coupling. The ungrounded transmission line that feeds the antenna is capacitively coupled to the conductive coating on the window by a strip metallic print that overlaps the conductive coating. The size of the metallic strip and the overlapping area may be selected to excite the wideband resonance of the slot antenna to support applications of different electronics at different frequency bands.

Figure 1:
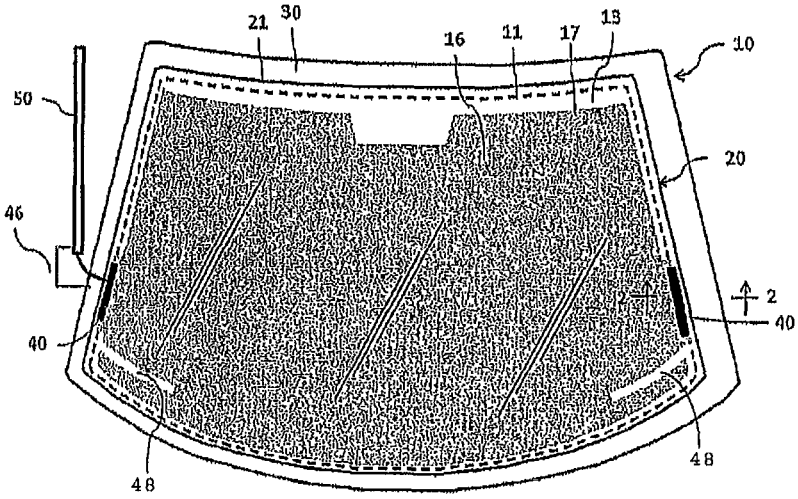
FIG. 1 illustrates a transparent glass antenna according to various embodiments of the present invention.
Figure 2:
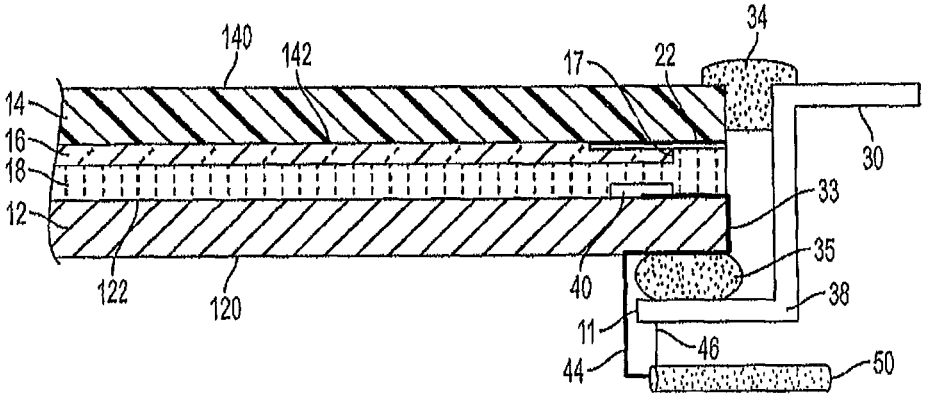
FIGS. 2-3 are sectional views taken along line 2-2 in FIG. 1 in accordance with various embodiments of the present invention.

FIG. 1 illustrates a transparent windshield assembly 10 and its associated body structures according to various embodiments of the present invention. A windshield 20 is surrounded by a metal frame 30, which has a window aperture defined by a vehicle body window edge 11. As described herein, embodiments of the present invention may be used on windows and window assemblies that are not windshields but other types of windows or window assemblies. For example, embodiments of the present invention may be incorporated into any window or sunroof. In the interests of clarity, all such windows and window assemblies are referred to herein as windshield 20. An outer edge 21 of the windshield 20 overlaps an annular flange 38 of the frame 30 to allow securing of the windshield 20 to the vehicle body of which the frame 30 is a part. As seen in FIG. 2, an annular sealing member 35 is placed between the windshield 20 and the flange 38 and a molding 34 bridges the outer gap between the frame 30 and the windshield 20.

The windshield 20 may be a standard laminated vehicle windshield formed of outer glass ply 14 and inner glass ply 12 bonded together by an interposed layer, or interlayer, 18. The interlayer 18 may be constructed of, for example, a standard polyvinylbutyral or any type of plastic material. The outer glass ply 14 has an outer surface 140 (conventionally referred to as the number 1 surface) on the outside of the vehicle and an inner surface 142 (conventionally referred to as the number 2 surface). The inner glass ply 12 has an outer surface 122 (conventionally referred to as the number 3 surface) on the inside of the vehicle and an inner surface 120 (conventionally referred to as the number 4 surface) internal to the windshield 20. The interlayer 18 is between the surfaces 142 and 122.

As shown in FIG. 2, the windshield 20 may include a dark, or black, paint band 22 around the perimeter of the windshield 20 to conceal the antenna elements and other apparatus (not shown) around the edge of the windshield 20.

The windshield 20 further includes an electro-conductive element, or conductive coating, 16 which occupies the daylight opening of the transparency. The coating 16 may be constructed of transparent electro-conductive coatings applied on the surface 142 of the outer glass ply 14 (as shown in FIG. 2) or on the surface 122 of the inner glass ply 12, in any manner known in the art. The coating 16 may include in single or multiple layers, a metal containing coating such as, for example, those disclosed in U.S. Pat. Nos. 3,655,545 to Gillery et al., 3,962,488 to Gillery and 4,898,789 to Finley.

The conductive coating 16 has a peripheral edge 17 which is spaced from the vehicle body window edge 11 and defines an annular antenna slot 13 between the edge 11 and the peripheral edge 17. In one embodiment, the slot width is sufficiently large enough that the capacitive effects across it at the frequency of operation are negligible such that the signal is not shorted out. In one embodiment, the slot width is greater than 10 mm. In one embodiment, the length of the slot 13 is an integer multiple of wavelength for an annular slot or an integer multiple of one-half of the wavelength for non-annular slot with respect to resonant frequency of the desired application. For a windshield of a typical vehicle, the slot length is such as to resonant at the VHF band and can be used for TV VHF band and FM applications.

The antenna may be fed by an unbalanced transmission line such as a coaxial cable that is capacitively coupled to the coating 16 using a small metallic layer that is selected to match the antenna impedance to the transmission line impedance. As shown in FIG. 1, the coating 16 (on the surface 142) and antenna feeding elements 40 (on the surfaces 120 or 122) may be overlapped in the antenna feeding area to form a parallel plate capacitor. The capacitance needed for matching the antenna impedance may be adjusted by changing the size of the feeding elements 40 and overlapping area between the elements 40 and the coating 16 for the frequency bands of interest.

FIG. 2 illustrates one embodiment in which the slot antenna feeding elements 40 are incorporated between the glass plies 12 and 14. The feeding elements 40 may be a metal layer, such as a copper tape, a silver ceramic, or any other metal tape, that is bonded to the surface 122 of the inner glass ply 12 and is separated from the coating 16 by the interlayer 18. A metal foil, such as a copper foil, 33, which is conductively connected to the feeding elements 40, is folded back around the edges of the interlayer 18 and the inner glass ply 12 and is sandwiched between the surface 120 of the inner glass ply 12 and the sealing member (e.g., a glue bead) 35. The foil 33 is conductively connected to a center conductor 44 of a coaxial cable 50. The foil 33 may be covered by, for example, a plastic tape so that it is isolated from contact with the frame 30 and shorts out the radio frequency signals when they pass through the window flange 38 and the sealing member 35. The cable ground 46 is connected to the frame 30 near the inner metal edge 11 of the window flange 38.

Figure 3:
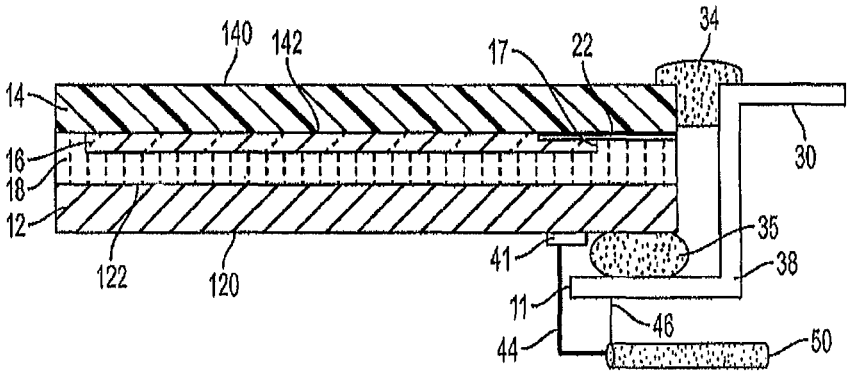

FIG. 3 illustrates an embodiment in which an antenna feeding element 41 such as, for example, a metal tape or a silver ceramic, is bonded to the interior surface 120 of the inner glass ply 12. The feeding element 41 is separated from the coating 16 by the interlayer 18 and the inner glass ply 12. The center conductor 44 of the coaxial cable 50 is connected to the feeding element 41 by an insulated wire or foil in, for example, a conventional manner, such as soldering or through a mating blade connector.

The capacitive coupling may preferably, in various embodiments, be an antenna feeding arrangement because in various embodiments it provides a relatively easier manufacturing process and gives an opportunity for antenna tuning and impedance matching. The antenna feeding arrangement presents an impedance transfer into the slot antenna modes with its own impedances, which is a function of the intended operating frequency, feed position, shape and size of the feeding element and the distance to the vehicle frame ground. Only modes of the slot antenna 13 that are matched to the transmission line characteristic impedance, for example 50Ω, can be excited. Compared to the direct feed as shown in FIG. 2, the capacitive coupling feed as shown in FIG. 3 may provide easier access for tuning the capacitance for impedance matching because the antenna feeding element 41 is on the interior surface 120 of the inner glass ply 12. The impedance of the slot antenna 13 in accordance with embodiments of the present invention has a real component and a reactive component. In various embodiments, the VHF band of the slot antenna 13 was found to have a reactive component which is conductive. Only the real part represents radiation loss. Because the capacitance between the antenna feeding element 41 and the coating 16 is determined by the interfacing area, the distance between the elements, and the dielectric constant of the material, the interfacing area and the distance can be selected by design to match the antenna to the transmission line and thus minimize the net reactive component seen by the transmission line and thereby maximize radio frequency energy transfer, especially for the VHF frequency band. The antenna feed location can be selected such that certain modes can be excited for each application of different frequencies. The capacitive coupling also provides DC isolation from the coating 16 when the resistance of the coating 16 is used for, for example, defogger or deicing purposes.

Referring again to FIG. 1, in one embodiment two antennas may be symmetrically located along an A-pillar of the vehicle body in which the windshield 20 is mounted. In one embodiment the two antenna feeds are at least λ/4 wavelength apart and are weakly coupled and thus both can be used simultaneously for, for example, an FM and TV diversity antenna system. The antenna can be fed at the top and the bottom of the windshield 20 resulting in more spatial and pattern diversity. The antenna feed at the sides provides more antenna gain for horizontal polarization while the antenna feed at the top and bottom gives more gain in vertical polarization.

The resonant frequencies of the antenna fundamental modes are determined predominantly by the slot length, which can be designed such that the mode resonant frequencies are aligned with the operation frequencies of vehicle electronics systems. The slot length can be increased by introducing one or more slits near the edge portions of the coating 16 by removing a portion or portions of the coating 16. The radio frequency current is forced to detour around the slits and therefore increases the electrical length of the slot 13. As a result the resonant mode frequency is shifted towards a lower frequency band. FIG. 1 shows two slits 48 formed by removing portions of the coating 16 at targeted areas either through, for example, mask or laser deletion. The length, width, and number of the slits 48 are determined by the size of the windshield 20 and the frequency band of interest. In one embodiment, the slits 48 are introduced in any part of the coating 16 in, for example, the dark paint band 22 such that the deletion is not visible.

Figure 5:
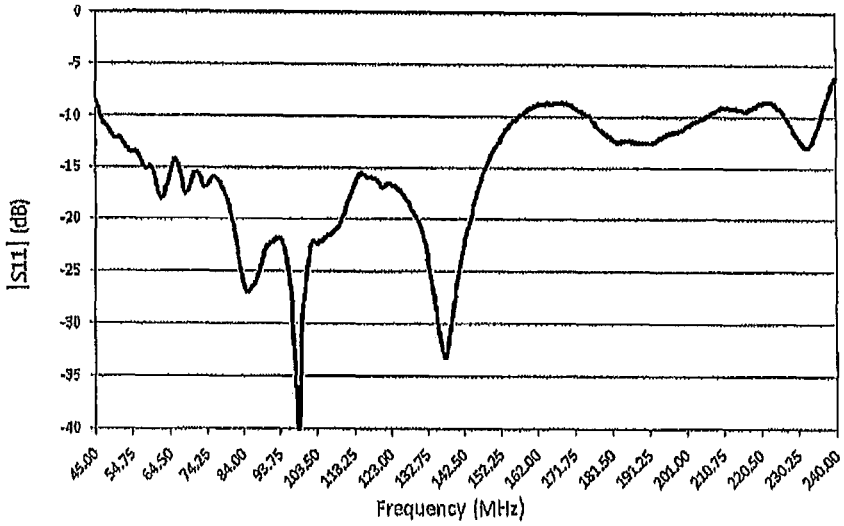
FIG. 5 is a plot of antenna return loss in the antenna resonant frequency band from 45 MHz to 240 MHz.

An embodiment similar to that illustrated in FIGS. 1 and 3 was constructed and tested. A feeding element 41 of 160 mm long and 10 mm wide was used in such embodiment. In one embodiment, the capacitance area is an overlapping area of the feeding element 41 and the coating 16 on the order of ten to twenty square centimeters for the VHF band. FIG. 5 is a plot of the return loss (S11) of the slot antenna 13 that shows that the antenna radiates and receives well in a very wide VHF band from 45 MHz up to 240 MHZ which covers TV band I (47-68 MHz), Japan FM band (76 MHz-90 MHz), USA/Europe FM (87.9 MHz-108 MHz), weather band (162.4 MHz-162.55 MHz), TV band III (174 MHz-230 MHz) and digital audio broadcasting (DAB) band III (174 MHz-240 MHz).

Figure 4:
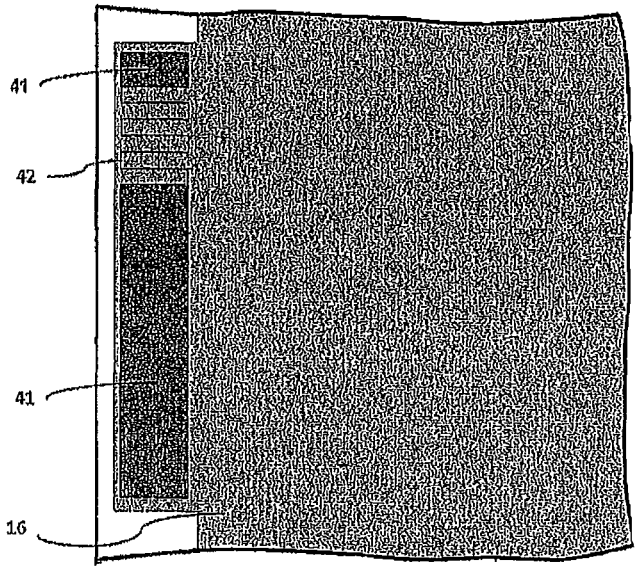
FIG. 4 illustrates a transparent glass antenna according to various embodiments of the present invention.

The impedance of the slot antenna 13 in accordance with embodiments of the present invention was found to have a reactive component which is capacitive in the UHF band. The inductor 42 is introduced to partly compensate for the capacitive reactance of the impedance in the UHF band. This is shown in FIG. 4 where the feeding element 41 is divided so as to provide the inductor 42 in the middle portion. The value of the inductance is designed to match the capacitive reactance of the antenna, which is a function of the intended operating frequency, the size and shape of the windshield 20 and the antenna feeding positions.

Figure 6:
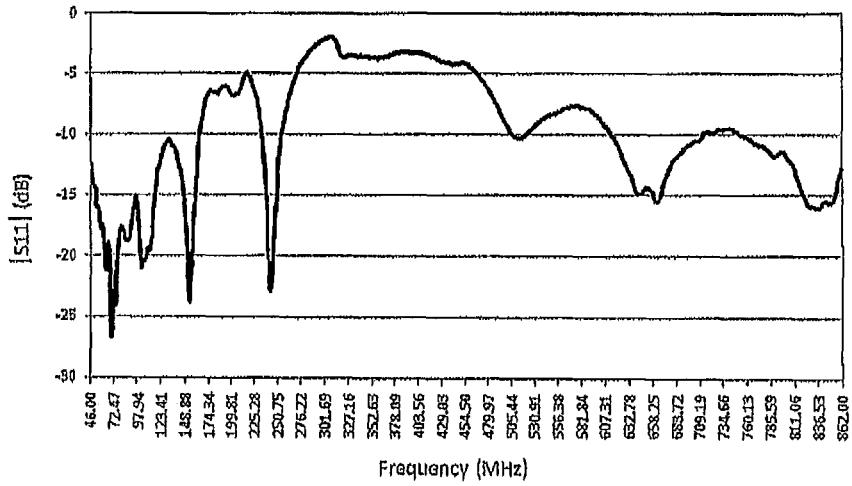
FIG. 6 is a plot of antenna return loss in the antenna resonant frequency band from 46 MHz to 862 MHz.

An embodiment similar to that illustrated in FIG. 1 but with the added inductor 42 as shown in FIG. 4 was constructed and tested. FIG. 6 is a plot of the return loss (S11) of the slot antenna 13, which shows the antenna radiates and revives well in both the VHF band from 47 MHz to 240 MHz and the UHF band from 470 MHz to 860 MHz. The slot antenna demonstrates the capability for multi-band application which can reduce the number of antennas, simplify antenna amplifier design, and reduce overall costs for the antenna system.

Embodiments of the present invention are directed to a transparent slot antenna for, by way of example, a vehicle such as an automobile. The slot antenna includes an electro-conductive coating on the surface of an outer glass ply applied to an area of the window. The conductive coating peripheral edge is spaced from the window edge to define an annular slot antenna. A capacitive coupling feed structure is used to match the slot antenna at a very wide frequency band to cover the frequency range from, for example, 45 MHz to 860 MHz which includes TV, FM, weather band, Remote Keyless Entry (RKE), and DAB III frequency band.

While several embodiments of the invention have been described, it should be apparent that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention.

What is claimed is:

1. A window assembly for use in connection with a window frame having a metal edge, said window assembly cooperating with said window frame to define at least one antenna that is electrically connectable to an electrical feed, said window assembly comprising:

at least one ply;

an electro-conductive coating that is located on a surface of said at least one glass ply, said electro-conductive coating having a peripheral edge wherein, at times when said window assembly is installed in said window frame, at least a first portion of the peripheral edge is spaced away from the metal edge of the window frame to define a slot antenna between the first portion of said peripheral edge and the metal edge of said window frame;

an antenna feed structure that is electrically connected to the first portion of the peripheral edge of the electro-conductive coating; and a coupling strip for electrically connecting said antenna feed structure and the electrical feed, said coupling strip having a coupling element that is located opposite from at least a portion of the antenna feed structure said coupling element being positioned with respect to the first portion of the peripheral edge of the electro-conductive coating to match the impedance of said antenna with respect to the impedance of the electrical feed, said coupling strip also having an electrical conductor that is connected to said coupling element and that is electrically connectable to the electrical feed.

2. The window assembly as claimed in claim 1, wherein said coupling strip matches the impedance of the slot antenna to the impedance of the electrical feed over a frequency bandwidth of from approximately 47 MHz to 240 MHz.

3. The window assembly as claimed in claim 1, wherein said coupling strip matches the impedance of the slot antenna to the impedance of the electrical feed over a frequency bandwidth of from approximately 47 MHz to 240 MHz and 470 MHz to 860 MHz.

4. The window assembly as claimed in claim 1, wherein the coupling strip is bifurcated into a first part and a second part, said coupling strip further comprising an inductor that is disposed between the first part of the coupling strip and the second part of the coupling strip.

5. The window assembly as claimed in claim 4, wherein the inductor is sized such that an impedance of the slot antenna is matched to an impedance of a transmission line that is in electrical communication with the antenna feed structure.

6. The window assembly as claimed in claim 1, wherein the antenna feed structure is located in a dark paint band that is located on a peripheral area of the window assembly.

7. The window assembly as claimed in claim 1, wherein the width of the antenna slot is sized such that a capacitive effect across the antenna slot is substantially negligible for at least one operation frequency.

8. The window assembly as claimed in claim 7, wherein the width of the antenna slot is greater than 10 mm.

9. The window assembly as claimed in 1, wherein a total length of the antenna slot is one wavelength for an annular slot antenna and one-half wavelength for a non-annular slot antenna, at the fundamental excitation mode.

10. The vehicle window assembly as claimed in 1, wherein the antenna feed structure is capacitively coupled to the slot antenna.

11. The window assembly as claimed in claim 1, wherein the interlayer comprises plastic.

12. The window assembly as claimed in claim 1, wherein the electro-conductive coating is substantially transparent.

13. The window assembly of claim 1 wherein the length of the first portion of said peripheral edge of said electro-conductive coating determines the effective electrical length of said slot antenna.

14. The window assembly of claim 13 wherein the first portion of said peripheral edge includes at least one slit in the peripheral edge of said electro-conductive coating, said at least one slit increasing the effective electrical length of said slot antenna to tune said slot antenna to a predetermined resonant frequency.

15. The window assembly of claim 14 wherein the peripheral edge of said electro-conductive coating includes more than one slit.

16. A window assembly for use in connection with a window frame having a metal edge, said window assembly cooperating with said window frame to define at least one antenna that is electrically connectable to an electrical feed, said window assembly comprising:

at least a first ply;

an electro-conductive coating that is located on a surface of said first ply, said electro-conductive coating having a peripheral edge wherein, at times when said window assembly is installed in said frame, at least a first portion of the peripheral edge is spaced away from the metal edge of the frame to define a slot antenna between the first portion of said peripheral edge and the metal edge of said frame, and wherein at least a second portion of the peripheral edge of said electro-conductive coating overlaps the metal edge of said frame, said second portion of said peripheral edge defining an antenna feeding area within said electro-conductive coating; and a coupling strip for electrically connecting said antenna feeding area and the electrical feed, said coupling strip having a coupling element that is located opposite from the antenna feeding area of the electro-conductive coating, said coupling strip also having an electrical conductor that is connected to said coupling element and that is electrically connectable to the electrical feed.

17. The window assembly as claimed in claim 16, wherein said coupling strip matches the impedance of the slot antenna to the impedance of the electrical feed over a frequency bandwidth of from approximately 47 MHz to 240 MHz.

18. The window assembly as claimed in claim 16, wherein said coupling strip matches the impedance of the slot antenna to the impedance of the electrical feed over a frequency bandwidth of from approximately 47 MHz to 240 MHz and 470 MHz to 860 MHz.

19. The window assembly as claimed in claim 16, wherein the coupling strip is bifurcated into a first part and a second part, said coupling strip further comprising an inductor that is disposed between the first part of the coupling strip and the second part of the coupling strip.

20. The window assembly as claimed in claim 19, wherein the inductor is sized such that an impedance of the slot antenna is matched to an impedance of a transmission line that is in electrical communication with the antenna feeding area.

21. The window assembly as claimed in claim 16, wherein the antenna feeding area is located in a dark paint band that is located on a peripheral area of the window assembly.

22. The window assembly as claimed in claim 16, wherein the width of the antenna slot is sized such that a capacitive effect across the antenna slot is substantially negligible for at least one operation frequency.

23. The window assembly as claimed in claim 22, wherein the width of the antenna slot is greater than 10 mm.

24. The window assembly as claimed in claim 16, wherein a total length of the antenna slot is one wavelength for an annular slot antenna and one-half wavelength for a non-annular slot antenna, at the fundamental excitation mode.

25. The window assembly as claimed in claim 16, wherein the antenna feeding area is capacitively coupled to the slot antenna.

26. The window assembly as claimed in claim 16, wherein the interlayer comprises plastic.

27. The window assembly as claimed in claim 16, wherein the electro-conductive coating is substantially transparent.

28. The window assembly of claim 16 wherein said coupling element is located with respect to said antenna feeding area to tune the impedance of said slot antenna with respect to the impedance of said electrical feed.

29. The window assembly of claim 28 wherein the coupling element of said coupling strip is comprised of a first part and a second part and wherein the coupling element further includes an inductor section that electrically connects said first part and said second part.

30. The window assembly of claim 29 wherein said inductor section partially offsets the capacitance effect of said slot antenna.

31. The window assembly of claim 29 wherein the effective electrical length of the slot corresponds to a wavelength at resonant frequency in the ultra-high frequency band.

32. The window assembly of claim 29 wherein the effective electrical length of the slot antenna corresponds to a wavelength at a frequency in the range of 470 MHz to 860 MHz.

33. The window assembly of claim 29 wherein said first and second parts of said coupling element are positioned to tune the impedance of the slot antenna with respect to the impedance of said electrical feed.

34. The window assembly of claim 29 wherein said first part of said coupling element is positioned with respect to said antenna feed area to tune impedance in the UHF band.

35. A window assembly for use in connection with a window frame having a metal edge, said window assembly cooperating with said window frame to define at least one antenna that is electrically connectable to an electrical feed, said window assembly comprising:

a transparent ply;

an interlayer that faces one side of said transparent ply;

an electro-conductive coating that is located on a surface of one of said transparent ply and said interlayer, said electro-conductive coating having a peripheral edge wherein, at times when said window assembly is installed in said window frame, at least a first portion of the peripheral edge is spaced away from the metal edge of the window frame to define a slot antenna between the first portion of said peripheral edge and the metal edge of said window frame, and wherein at least a second portion of the peripheral edge of said electro-conductive coating overlaps the metal edge of said window frame, said second portion of said peripheral edge defining an antenna feeding area within said electro-conductive coating; and a coupling strip for electrically connecting said antenna feeding area and the electrical feed, said coupling strip having a coupling element that is located on one of said inner transparent ply and said interlayer at a position that is opposite from the antenna feeding area of the electro-conductive coating, said coupling strip also having a foil that is electrically connected to said coupling element and that is electrically connectable to the electrical feed.

36. The window assembly as claimed in claim 35, wherein said coupling strip matches the impedance of the slot antenna to the impedance of the electrical feed over a frequency bandwidth of from approximately 47 MHz to 240 MHz.

37. The window assembly as claimed in claim 35, wherein said coupling strip matches the impedance of the slot antenna to the impedance of the electrical feed over a frequency bandwidth of from approximately 47 MHz to 240 MHz and 470 MHz to 860 MHz.

38. The window assembly as claimed in claim 35, wherein the coupling strip is bifurcated into a first part and a second part, said coupling strip further comprising an inductor that is disposed between the first part of the coupling strip and the second part of the coupling strip.

39. The window assembly as claimed in claim 38, wherein the inductor is sized such that an impedance of the slot antenna is matched to an impedance of a transmission line that is in communication with the antenna feeding area.

40. The window assembly as claimed in claim 35, wherein the antenna feeding area is located in a dark paint band that is located on a peripheral area of the window assembly.

41. The window assembly as claimed in claim 35, wherein the width of the antenna slot is sized such that a capacitive effect across the antenna slot is substantially negligible for at least one operation frequency.

42. The window assembly as claimed in claim 41, wherein the width of the antenna slot is greater than 10 mm.

43. The window assembly as claimed in claim 35, wherein a total length of the antenna slot is one wavelength for an annular slot antenna and one-half wavelength for a non-annular slot antenna, at the fundamental excitation mode.

44. The window assembly as claimed in claim 35, wherein the antenna feeding area is capacitively coupled to the slot antenna.

45. The window assembly as claimed in claim 35, wherein the interlayer comprises plastic.

46. The window assembly as claimed in claim 35, wherein the electro-conductive coating is substantially transparent.

* * * * *